US009212819B2

(12) United States Patent
Sanderson

(10) Patent No.: US 9,212,819 B2
(45) Date of Patent: Dec. 15, 2015

(54) SWIRLED FUEL INJECTION

(75) Inventor: Victoria Sanderson, Sutton-cum-Beckingham (GB)

(73) Assignee: SIEMENS AKTIENGESELLSCHAFT, München (DE)

( * ) Notice: Subject to any disclaimer, the term of this patent is extended or adjusted under 35 U.S.C. 154(b) by 246 days.

(21) Appl. No.: 13/806,237

(22) PCT Filed: Jun. 15, 2011

(86) PCT No.: PCT/EP2011/059927

§ 371 (c)(1), (2), (4) Date: Mar. 5, 2013

(87) PCT Pub. No.: WO2012/000792

PCT Pub. Date: Jan. 5, 2012

(65) Prior Publication Data

US 2013/0216963 A1 Aug. 22, 2013

(30) Foreign Application Priority Data

Jul. 2, 2010 (EP) ..... 10168263

(51) Int. Cl.

| | |
|---|---|
| ***F23D 14/24*** | (2006.01) |
| ***F23D 11/38*** | (2006.01) |
| ***F23R 3/28*** | (2006.01) |

(52) U.S. Cl.

CPC ..... *F23D 14/24* (2013.01); *F23D 11/383* (2013.01); *F23R 3/28* (2013.01); *F23C 2900/07001* (2013.01); *F23D 2900/14021* (2013.01)

(58) Field of Classification Search

CPC ..... F23C 2900/07001; F23D 11/383; F02M 61/162; F02M 2200/29

USPC ..... 431/185, 12; 239/463

See application file for complete search history.

(56) References Cited

U.S. PATENT DOCUMENTS

| | | | | |
|---|---|---|---|---|
| 5,058,549 | A * | 10/1991 | Hashimoto et al. | 123/298 |
| 7,784,716 | B2 * | 8/2010 | Fukutomi et al. | 239/533.12 |
| 2006/0048745 | A1 * | 3/2006 | Huckelberry et al. | 123/306 |
| 2009/0065957 | A1 * | 3/2009 | Mao et al. | 261/78.1 |
| 2010/0071374 | A1 | 3/2010 | Fox | |

FOREIGN PATENT DOCUMENTS

| | | | |
|---|---|---|---|
| DE | 1451351 | A1 | 1/1969 |
| EP | 2107304 | A1 | 10/2009 |

* cited by examiner

*Primary Examiner* — Avinash Savani

(57) ABSTRACT

A fuel injection duct for a combustion apparatus is provided. The fuel injection duct includes an inlet opening, an outlet opening, and an inner surface, wherein the inner surface exhibits a surface structure imparting a swirl to fuel moving from the inlet opening to the outlet opening, the fuel interacting with the surface structure of the inner surface. The manufacture of the fuel injection duct is easy and cost-effective and imparts a swirl to fuel flowing through the fuel injection duct.

14 Claims, 1 Drawing Sheet

SWIRLED FUEL INJECTION

CROSS REFERENCE TO RELATED APPLICATIONS

This application is the U.S. National Stage of International Application No. PCT/EP2011/059927, filed Jun. 15, 2011 and claims the benefit thereof. The International Application claims the benefits of European Patent Office application No. 10168263.1 EP filed Jul. 2, 2010. All of the applications are incorporated by reference herein in their entirety.

FIELD OF INVENTION

The present invention relates to a combustion apparatus. More particularly, the present invention relates to a swirled injection of fuel into a chamber like the pre-chamber or the combustion chamber of a combustion apparatus.

BACKGROUND OF INVENTION

In combustion systems it is desirable to achieve low emissions (NOx). These emissions are highly dependent on the extent of the mixing of fuel with an oxidant. An improved mixing of the fuel with the oxidant brings the combustion system closer to an ideally mixed system and therefore reduces the emissions (NOx).

To improve mixing of the fuel with the oxidant in prior art combustion systems fuel simply is injected into a cross flow of air through simple holes upstream of the combustion flame. Thereby, the mixing is driven by the flow patterns and the level of turbulence. Nevertheless, the mixing achieved with this approach is not satisfactory. Furthermore, fuel injection in the prior art is known in which for an improvement of the mixing of fuel with the oxidant the fuel is injected into a chamber of a combustion apparatus, wherein a swirl is imparted to the fuel by an injection device. This prior art injection device comprises an injection duct in combination with a separate structure inserted into the injection duct. The fabrication of a corresponding injection device is complex and costly.

SUMMARY OF INVENTION

An object of the present invention is to provide an easy to fabricate and cost-effective injection duct for a combustion apparatus which imparts a swirl to fuel flowing through the injection hole.

This object is solved by a fuel injection duct for a combustion apparatus according to the claims of the present invention and by a combustion apparatus according to the claims of the present invention. Advantageous embodiments are disclosed in the dependent claims of the present invention.

More particularly, according to the present invention there is provided a fuel injection duct for a combustion apparatus which comprises an inlet opening, an outlet opening, and an inner surface, wherein the inner surface exhibits a surface structure imparting a swirl to fuel moving from the inlet opening to the outlet opening, the fuel interacting with the surface structure of the inner surface.

The above disclosed injection duct is easy to fabricate since it does not comprise a separate structure inserted into the injection duct. Moreover, the fabrication costs of an injection duct according to the present invention are lowered since no separate structure has to be inserted into the injection duct for imparting a swirl to fuel flowing through the injection duct.

In the above described fuel injection duct the cross section of the inlet opening between the surface structures—taken perpendicular to the main direction of the fluid flow—can be an open—i.e. free of inserts—flow area. In other words, said cross section can define the hydraulic diameter of the fuel injection duct. Other components inside said cross section, like inserts or obstructions or the like, may not be present. With said definition of the open flow area, the geometrical dimension of the fuel injection duct can be minimized. The whole volume inside the fuel injection duct is used for the transport of the fuel as well as for the interaction between the fuel and the surface structure.

It is also possible that in the above described fuel injection duct, the surface structure is arranged at the inner surface such that it gets into flow contact with the fuel flowing along the inner surface from the inlet opening to the outlet opening. Therefore, the fuel flowing from the inlet opening to the outlet opening at least partly gets into interaction with the surface structure. Said interaction leads to the swirl of the fuel according to the present invention. Thereby, said interaction can take place between the complete fuel flow or only the part of the fuel flow following the inner surface.

In the above described fuel injection duct, it is possible that the inlet opening and the outlet opening are facing each other. The facing of the two openings, which are preferably of at least almost the same diameter, results in the advantage that the fuel flow is not reduced by the fuel injection duct. Moreover, no pressure loss can be created by any diameter differences and/or bends and curves of the fuel injection duct. Moreover, the inlet opening and the outlet opening can comprise parallel and/or coaxial axes. Thereby, the fuel can be formed like a swirling jet instead of a fuel film.

In the above described fuel injection duct the surface structure of the inner surface can comprise a helical structure. With an inner surface of the fuel injection duct comprising a helical structure a swirl can be effectively imparted to fuel flowing through the injection duct.

In the above described fuel injection ducts the surface structure can comprises at least one groove imparting a swirl to fuel moving from the inlet opening to the outlet opening. The fabrication of a corresponding fuel injection duct is very easy since the at least one duct simply can be cut out of the inner surface of the fuel injection duct.

The present invention is not limited thereto, that the surface structure only comprises one groove. The surface structure can also comprise more than one groove which enhances imparting a swirl to fuel flowing through the fuel injection duct.

In the above described fuel injection ducts the surface structure can comprise at least one protrusion imparting a swirl to fuel moving from the inlet opening to the outlet opening. With an inner surface comprising a protrusion a swirl can be very effectively imparted to fuel flowing through the injection duct.

The present invention is not limited thereto, that the surface structure only comprises one protrusion. The surface structure can also comprise more than one protrusion which enhances imparting a swirl to fuel flowing through the fuel injection duct.

In the above described fuel injection ducts the surface structure can extend fully from the inlet opening and/or to the outlet opening. Said construction leads to an interaction between the fuel flow and the surface structure from the very beginning after the fuel has entered the fuel injection duct and/or until the very end until the fuel leaves the fuel injection duct. Thereby, the overall length of the fuel injection duct can be used to interact with the fuel flow and the efficiency of the fuel injection duct can be optimized by limiting the geometrical size of the fuel injection duct at the same time. Preferably, the diameter of the fuel injection duct is constant or at least almost constant between the inlet opening and the outlet opening.

In the above described fuel injection ducts the fuel connection duct can be formed in one piece. The fabrication of a corresponding fuel injection duct is very easy and cost-effective. Protrusions can e.g. be bonded to the inner surface of the injection duct.

Moreover, in the above described fuel injection ducts the fuel connection duct can be monolithic. The fabrication of a corresponding fuel injection duct is very easy and cost-effective since the injection duct can e.g. simply be cast.

In the above described fuel injection ducts the inner surface can be cylindrical or conical or eccentric.

BRIEF DESCRIPTION OF THE DRAWINGS

The present invention also discloses a combustion apparatus which comprises at least one of the above described fuel injection ducts.

The present invention will now be described by way of example with reference to the accompanying drawings, in which.

DETAILED DESCRIPTION OF INVENTION

Figure 1:
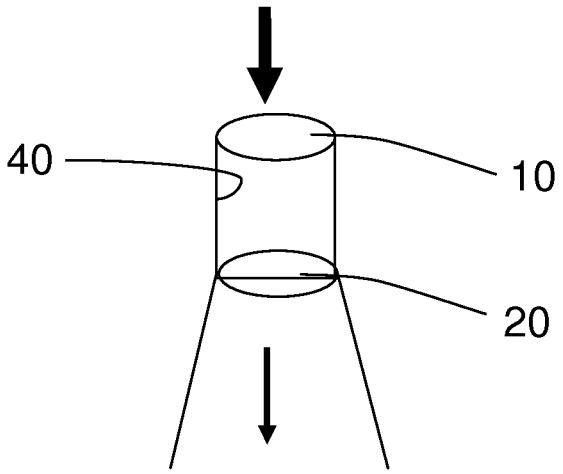
FIG. 1 is a schematic view of a fuel injection duct according to the prior art.

FIG. 1 of the present invention shows a schematic view of a fuel injection duct according to the prior art. Fuel indicated by the arrow in the upper part of FIG. 1 is supplied to the inlet opening 10 of the fuel injection duct. This supply can e.g. be conducted by a not shown fuel compressor. The supplied fuel is outputted of the fuel injection duct through the outlet opening 20, wherein no flow structure is imparted to the fuel flowing through the fuel injection duct according to the prior art. The fuel outputted through the outlet opening 20 is simply injected into a not shown cross flow of air through the simple injection duct upstream of the combustion flame. Thereby, the mixing is driven by the flow patterns and the level of turbulence.

Figure 2:
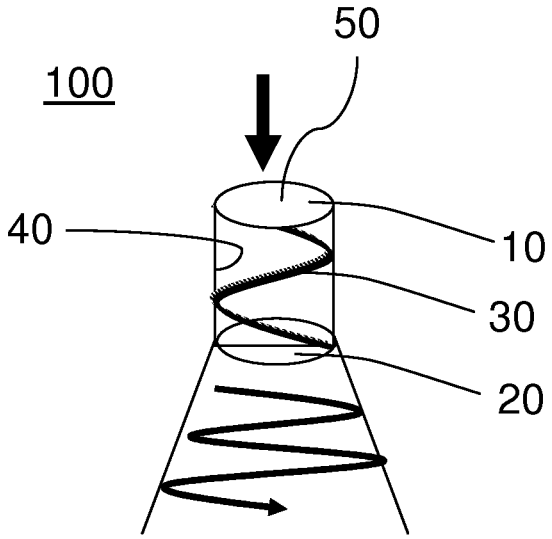
FIG. 2 is a schematic view of a fuel injection duct according to the present invention.

FIG. 2 of the present invention shows a schematic view of a fuel injection duct 100 according to the present invention. The fuel injection duct 100 shown in FIG. 2 comprises an inlet opening 10, an outlet opening 20, and an inner surface 40. The inner surface 40 exhibits a surface structure 30 which imparts a swirl to fuel moving from the inlet opening 10 to the outlet opening 20. For imparting a swirl to the fuel the fuel has to interact with the surface structure 30 of the inner surface 40 of the fuel injection duct 100.

Fuel outputted by a fuel injection duct 100 according to the present invention expands more rapid into the chamber where it is injected to, so that the mixing of the fuel with an oxidant is improved.

In FIG. 2 it is shown that the surface structure 30 exhibits a helical structure, i.e. a corkscrew like structure. Thereby, a swirl can be imparted to the fuel flowing through the fuel injection duct 100.

The surface structure 30 can exhibit a not shown groove. Fuel flowing through the fuel injection duct 100 and interacting with the surface structure 30 exhibiting at least one groove is brought into a rotational state. When this fuel is outputted by the outlet opening 20 of the fuel injection duct, it expands more rapid into the chamber where it is outputted to, so that the mixing of the fuel with an oxidant is improved.

Moreover, the surface structure 30 can exhibit a not shown protrusion. Fuel flowing through the fuel injection duct 100 and interacting with the surface structure 30 exhibiting at least one protrusion is brought into a rotational state. When this fuel is outputted by the outlet opening 20 of the fuel injection duct, it expands more rapid into the chamber where it is outputted to, so that the mixing of the fuel with an oxidant is improved.

Moreover, the surface structure 30 can exhibit a not shown groove and a not shown protrusion. Fuel flowing through the fuel injection duct 100 and interacting with the surface structure 30 exhibiting at least one groove and one protrusion is brought into a rotational state. When this fuel is outputted by the outlet opening 20 of the fuel injection duct, it expands more rapid into the chamber where it is outputted to, so that the mixing of the fuel with an oxidant is improved.

In FIG. 2 it is shown that the inner surface 40 of the fuel injection duct 100 is cylindrical. But the present invention is not limited to this geometry. The inner surface 40 of the fuel injection duct 100 instead can be conical or cylindrical. The person skilled in the art can adapt the geometry of the inner surface 40 of the fuel injection duct 100 depending on different requirements.

With the fuel injection duct 100 according to the present invention an improvement of the mixing of oxidant with fuel is realized, and at the same time a cost-effective and simple to manufacture fuel injection duct 100 is realized. The fuel injection duct 100 according to the present invention does not require any kind of separate structure inserted into the injection duct 100.

According to the invention the fuel injection duct 100 may not have an insert or insertion or obstruction or plug as a separate piece that gets inserted into the fluid path to guide the fluid flow between an outwards surface of this separate piece and the inner surface 40 of the fuel injection duct, e.g. along a helical structure. Thus, the inventive fuel injection duct is obstructionless or insertionless and allows fuel to pass along an axial direction of the fuel injection duct as the main direction of fuel injection. Furthermore (only) an additional swirl is generated from the surface structure of the inner surface 40 of the fuel injection duct.

Between the surface structures 30 the cross section is configured to be an open flow area 50, which can be defined as the hydraulic diameter. "Open" is meant again in the meaning that no insertion is place into the fuel injection duct 100. According to the invention the cross section of the fluid passage will be a circular area but will not be annular.

The above mentioned features particularly can be applied to a gas turbine combustion chamber as a combustion apparatus. Furthermore they can be located at various surfaces of a burner or a swirler provided in a gas turbine combustion chamber.

The invention claimed is:

1. A fuel injection duct for a combustion apparatus, comprising:

an inlet opening;

an outlet opening, wherein the fuel injection duct conducts only fuel from the inlet opening to the outlet opening; and a duct wall defining an inner surface, wherein the inner surface exhibits a surface structure imparting a swirl to the fuel moving from the inlet opening to the outlet opening, the fuel interacting with the surface structure of the inner surface, wherein the inner surface with the surface structure defines a conduit for the flow of said fuel, wherein the cross-section of the conduit is an open flow area, wherein the surface structure is a groove or a protrusion along the inner surface of the duct wall, imparting a swirl to fuel moving from the inlet opening to the outlet opening.

2. The fuel injection duct according to claim 1, wherein the surface structure is arranged at the inner surface such that it gets into flow contact with the fuel flowing along the inner surface from the inlet opening to the outlet opening.

3. The fuel injection duct according to claim 1, wherein the inlet opening and the outlet opening are facing each other.

4. The fuel injection duct according to claim 1, wherein the surface structure of the inner surface comprises a helical structure.

5. The fuel injection duct according to claim 1, wherein the surface structure comprises a groove and a protrusion imparting a swirl to fuel moving from the inlet opening to the outlet opening.

6. The fuel injection duct according to claim 1, wherein the surface structure extends fully from the inlet opening and to the outlet opening.

7. The fuel injection duct according to claim 1, wherein the surface structure extends fully from the inlet opening or to the outlet opening.

8. The fuel injection duct according to claim 1, wherein the fuel injection duct is formed in one piece.

9. The fuel injection duct according to claim 1, wherein the fuel injection duct is monolithic.

10. The fuel injection duct according to claim 1, wherein the inner surface is cylindrical, conical or eccentric.

11. The fuel injection duct according to claim 1, wherein the fuel injection duct is free of insertions.

12. The fuel injection duct according to claim 1, wherein a hydraulic diameter of the inlet opening is defined by the cross section of the inlet opening.

13. A combustion apparatus comprising:

a fuel injection duct according to claim 1.

14. A gas turbine engine comprising:

a combustion apparatus having a swirler, the swirler comprising:

a fuel injection duct comprising:

an inlet opening;

an outlet opening; and a duct wall defining an inner surface, wherein the inner surface exhibits a surface structure imparting a swirl to the fuel moving from the inlet opening to the outlet opening, the fuel interacting with the surface structure of the inner surface, wherein the inner surface with the surface structure defines a conduit for the flow of said fuel, wherein the cross-section of the conduit is an open flow area, wherein the surface structure is a groove or a protrusion along the inner surface of the duct wall, imparting a swirl to fuel moving from the inlet opening to the outlet opening, wherein the outlet opening is located at a surface of the swirler.

* * * * *